US010987599B1

(12) United States Patent
Fazio

(10) Patent No.: US 10,987,599 B1
(45) Date of Patent: Apr. 27, 2021

(54) INFLATABLE OR INJECTABLE TOY DEVICE

(71) Applicant: Testarossa Incorporated, Homer Glen, IL (US)

(72) Inventor: Stefano C. Fazio, Lemont, IL (US)

(73) Assignee: Testarossa Incorporated, Homer Glen, IL (US)

( * ) Notice: Subject to any disclaimer, the term of this patent is extended or adjusted under 35 U.S.C. 154(b) by 0 days.

(21) Appl. No.: 16/736,910

(22) Filed: Jan. 8, 2020

(51) Int. Cl.
*A63H 3/06* (2006.01)
*A63H 30/04* (2006.01)
*A63H 29/24* (2006.01)

(52) U.S. Cl.
CPC ..... *A63H 3/06* (2013.01); *A63H 29/24* (2013.01); *A63H 30/04* (2013.01)

(58) Field of Classification Search
CPC ..... A63H 27/10; A63H 2027/1041; A63H 2027/1033; A63H 2027/1083; A63H 3/06; A63H 13/16
USPC ..... 446/221, 223, 226; 472/51, 55, 134
See application file for complete search history.

(56) References Cited

U.S. PATENT DOCUMENTS 1,196,649 A 8/1916 Bochstahler
2,592,347 A * 4/1952 Shute ..... A63H 27/10 446/220
2,668,394 A 2/1954 Auzin
2,701,934 A 2/1955 Auzin
2,931,136 A 4/1960 Loewy
4,375,733 A 3/1983 Callais
5,002,514 A 3/1991 Takei
5,083,771 A * 1/1992 Tyner ..... A63H 27/10 116/DIG. 9
6,373,384 B1 * 4/2002 Ferguson ..... G08B 5/002 116/210
6,582,274 B1 6/2003 Chernek
9,474,986 B2 10/2016 Drylie
9,832,970 B1 12/2017 Conde
10,328,354 B2 6/2019 Bushell
2003/0066096 A1 4/2003 Bryan
2005/0282459 A1 12/2005 Chan
2008/0096458 A1 4/2008 Andersen
2017/0106297 A1 4/2017 Hashemi
2020/0167621 A1 * 5/2020 Chen ..... G06K 19/06037

* cited by examiner

*Primary Examiner* — Kien T Nguyen
(74) *Attorney, Agent, or Firm* — Kaspar Law Company, LLC; Scott R. Kaspar

(57) ABSTRACT

An inflatable toy device is disclosed, the toy including a base portion, the base portion having an inlet and an outlet, the outlet covered by a removable surface; an inflatable object disposed within the base portion when not inflated, the inflatable object being fluidly connected to the inlet; a hand pump fluidly connected to the inlet, the hand pump configured to create air pressure to inflate the inflatable object; wherein the inflatable object protrudes from the base portion outlet, thereby removing the removable surface, upon inflation. The toy device also may include an injectable object fluidly filled such that the injectable object protrudes from the base portion outlet upon being filled.

20 Claims, 3 Drawing Sheets

INFLATABLE OR INJECTABLE TOY DEVICE

TECHNICAL FIELD

The present invention relates to a toy device, and more particularly, to a toy device that emerges from a retracted position upon inflation of air or injection of fluid.

BACKGROUND

Small, inexpensive toys are well known in the children's toy marketplace. It is typical to find small, inexpensive toys in children's meal value packs commonly sold at quick-service restaurants, and such toys may be part of a collection, to encourage repeat sales such that a child may collect all of the toys of a collection. Toys of this nature often include small toy cars or devices having wheels that can propel the toy.

There exists a phenomenon in the children's toy marketplace wherein certain toys are sold in a closed box or bag without a complete description as to the toy. In the children's toy marketplace, these often are referred to as "blind bags," so named because children do not know what the specific toy is until opening the box or bag containing the toy. In this arrangement, much of the excitement of the toy is experienced upon the revealing of the toy.

Another phenomenon that exists in the children's toy marketplace is a toy having or including, or comprising, a low-viscosity fluid often referred to by children as "slime." The so-called "slime" often is colored, many times in bright colors, and may be scented or include certain solid objects suspended within the slime. Popular children's television shows and networks, or events, have made the use of slime exciting, and children may experience a tactile response from holding or kneading the slime.

SUMMARY OF THE INVENTION

According to one non-limiting aspect of the present disclosure, an example embodiment of an inflatable toy device is disclosed. The inflatable toy device includes a base portion, the base portion having an inlet and an outlet, the outlet covered by a removable surface; an inflatable object disposed within the base portion when not inflated, the inflatable object being fluidly connected to the inlet; a hand pump fluidly connected to the inlet, the hand pump configured to create air pressure to inflate the inflatable object; wherein the inflatable object protrudes from the base portion outlet, thereby removing the removable surface, upon inflation.

According to another non-limiting aspect of the present disclosure, an example embodiment of an injectable toy device is disclosed. The injectable toy device includes a base portion, the base portion having an inlet and an outlet, the outlet covered by a removable surface; an injectable object disposed within the base portion when not filled, the injectable object being fluidly connected to the inlet; a syringe fluidly connected to the inlet, the syringe having a plunger configured to create fluid pressure to fill the injectable object; wherein the injectable object protrudes from the base portion outlet, thereby removing the removable surface, upon being filled.

Additional features and advantages are described herein, and will be apparent from the following Detailed Description and the figures.

BRIEF DESCRIPTION OF THE DRAWINGS

Features and advantages of the system and method described herein may be better understood by reference to the accompanying drawings in which.

A skilled artisan will appreciate the foregoing details, as well as others, upon considering the following Detailed Description of certain non-limiting embodiments of the toy device according to the present disclosure. One of ordinary skill also may comprehend certain of such additional details upon using the toy device described herein.

DETAILED DESCRIPTION

The present disclosure, in part, is directed to a toy device, and more particularly, to a toy device that emerges from a retracted position upon inflation of air or injection of fluid into the toy.

Figure 1:
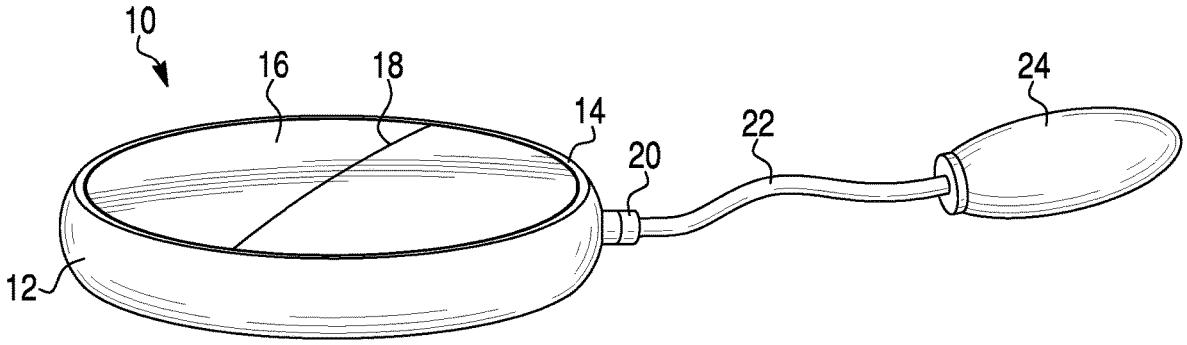
FIG. 1 depicts an embodiment of a toy device of the present disclosure, the toy device shown in a retracted position.

As shown in FIG. 1, a toy device 10 is disclosed, the toy device 10 having a base 12. The base 12 is shown being generally cylindrical in shape, but could be square or rectangular, or most any geometry. The base 12 is made of an extruded polymer, in which instance a cylindrical shape can be cost effectively manufactured, although the base 12 is not limited to only polymeric materials and may be made from any suitable material. Base 12 has an upper surface 14, shown in FIG. 1 as being generally circular, upon which a temporary or removable surface 16 may be affixed or adhered. Removable surface 16 may be a lightweight polymer or paper surface, such as a sticker, secured to the top surface 14 via an adhesive. Removable surface 16 may have a line of demarcation 18 generally dividing the removable surface into two or more halves or portions for ease of removal of the removable surface 16.

Base 12 also includes an inlet 20, disposed on a side or rear surface of the base 12, for connecting a tube or hose 22 to the base 12. The tube 22 secures to a hand pump 24, which forces atmospheric or ambient air into and through hose 22 and into base 12 upon compression or activation by a user.

Figure 2:
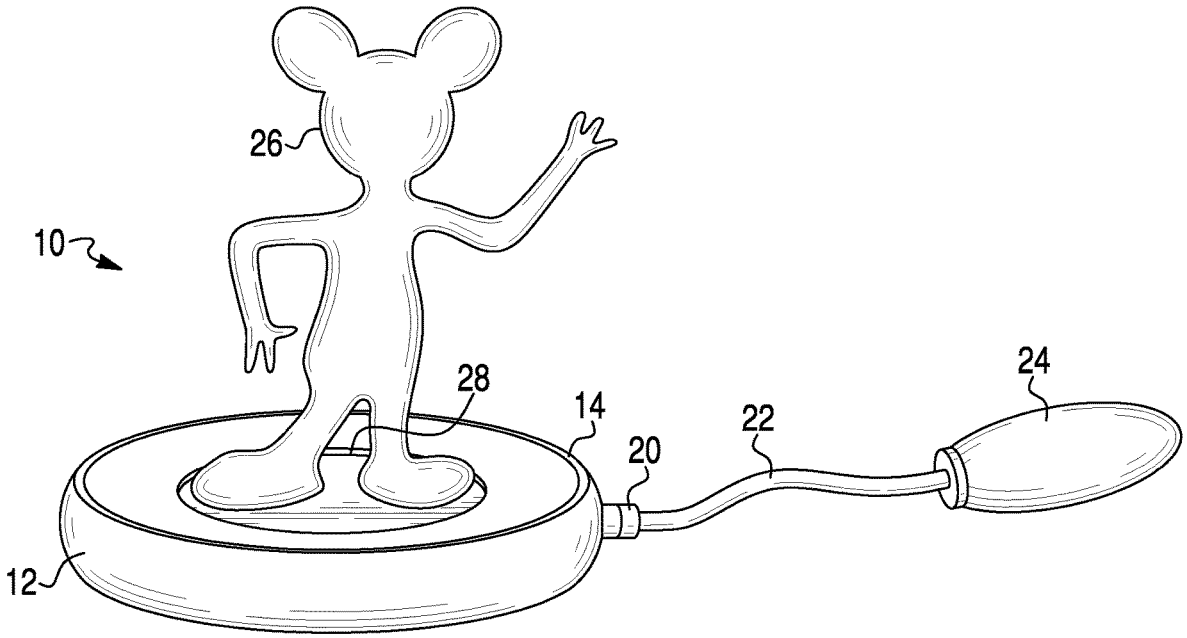
FIG. 2 depicts the toy device of FIG. 1 in which the device is shown in an inflated position.

As shown in FIG. 2, a character 26, which resides completely within the base 12 while in the retracted position of FIG. 1, protrudes from an outlet 28 on the top surface 14 of base 12, thereby forcing the removal of removable surface 16 upon compression or activation of the hand pump 24. Character 26 secures inside base 12 and is interconnected to the inlet 20 such that air pressure originating from hand pump 24 and traveling through hose 22 fluidly connects with character 26 to inflate character 26. As character 26 inflates with air, it moves from the retracted position, in which it is fully contained within base 12, to an upright position in which a substantial portion of character 26 protrudes through outlet 28 and is disposed outside of base 12, as generally shown in FIG. 2.

Character 26 may be any such figure, and may an object other than a character, such as a shape or any other inanimate object. Character 26 typically is made of a resilient material, such as a plastic or polymer, or may be made of rubber, neoprene, among other resilient materials. Character 26 may be comprised in whole or in part from a foam or sponge-like material, such as a "Squishy" toy, as often referred to in the children's vernacular.

Figure 3:
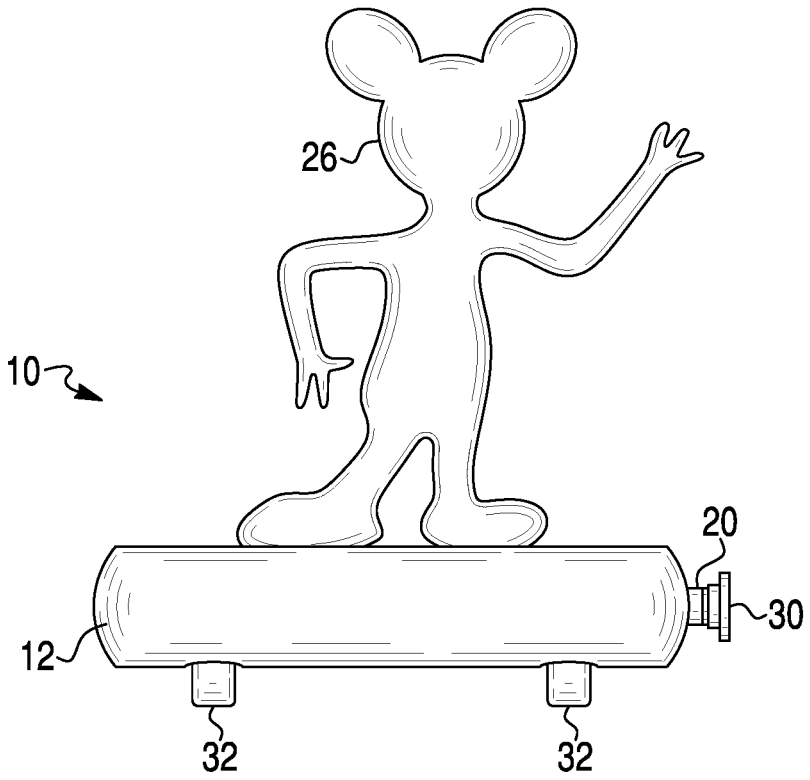
FIG. 3 depicts the toy device of FIG. 1 in which the device is shown in a position for use or play by a child.

As shown in FIG. 3, when the character 26 is disposed in the upright position, tube 22 and hand pump 24 may be removed from inlet 20, and inlet 20 may be closed, such as with a cap 30 or via a check valve or similar connection that retains air within character 26 and prevents the air from escaping back into the atmosphere via inlet 20. In this manner, character 26 may be permanently maintained in the upright position, such that toy device 10 can be used as a toy and played with by children.

Base 12 also may include wheels 32 protruding from a bottom surface of base 12, which allow the toy device 10 to be rolled or pushed about on the ground or a flat surface, such as a tabletop. Wheels 32 may be connected to an internal mechanism, such as a spring-loaded axle connected the wheels, which propels the toy device 10 upon being wound up or otherwise activated, such as by pulling back on the toy device 10 a short distance to energize the spring-loaded axle or similar mechanism. Alternatively, the base 12 may include a battery compartment for holding a battery to power a small internal motor, which may move the toy device 10, including as one example, a radio-controlled or remote-controlled motor device for powering the wheels 32 to propel the toy device 10.

Figure 4:
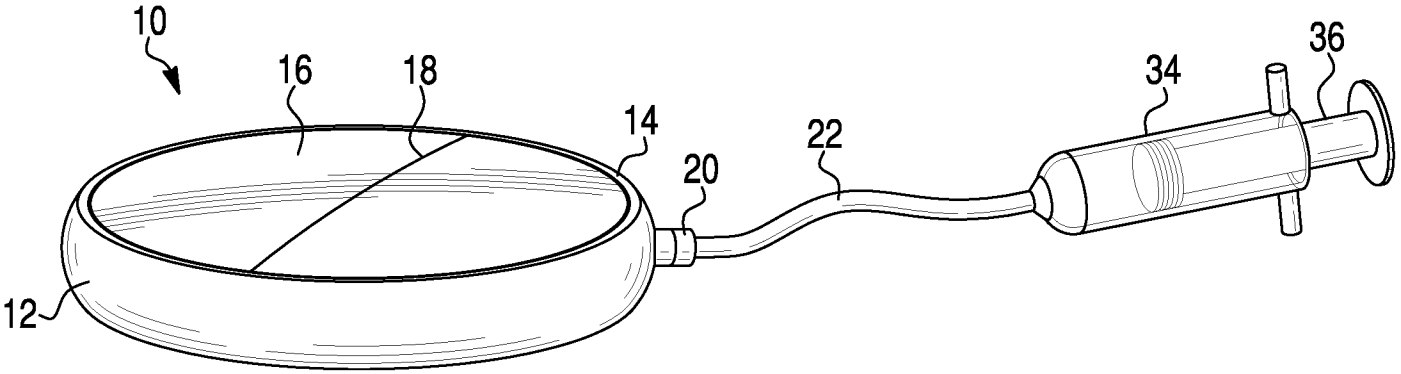
FIG. 4 depicts another embodiment of a toy device of the present disclosure, the toy device shown in a retracted position.

The character 26 may be moved from the retracted to upright positions by internally filling it with fluids other than air, such as, as another example, low-viscosity liquids such as "slime," as it is often referred to in the children's toy marketplace. As shown in FIG. 4, a syringe 34 may be connected to hose 22 to deliver a "slime" or slime-like liquid to the base 12 through inlet 20 by depressing a plunger 36, which thereby injects the slime-like liquid into the base to fill the character 26. Character 26 then becomes filled with the slime-like liquid, moving from the retracted to upright position. Once the character 26 is filled and in the upright position, the syringe 34 and hose 22 may be removed from the inlet 20, and inlet 20 may be closed or otherwise sealed, such as with a cap, to prevent the slime-like liquid from secreting out of the inlet 20. In such an upright position, the toy device 10, as filled with "slime," may be used or played with by a child.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended set of claims.

What is claimed is:

1. A toy device comprising:

a base portion, the base portion having an inlet and an outlet, the outlet covered by a removable surface;

an inflatable object disposed within the base portion when not inflated, the inflatable object being fluidly connected to the inlet;

a hand pump fluidly connected to the inlet, the hand pump configured to create air pressure to inflate the inflatable object;

wherein the inflatable object protrudes from the base portion outlet, thereby removing the removable surface, upon inflation.

2. The device of claim 1 further comprising a hose fluidly interconnecting the hand pump to the base portion inlet.

3. The device of claim 1 wherein compressing the hand pump inflates the inflatable object to move the inflatable object to an upright position substantially disposed outside of the base portion.

4. The device of claim 3 wherein the base portion inlet is configured to be closed to maintain the inflatable object in the upright position.

5. The device of claim 4 wherein the hand pump is configured to be removed from the base portion inlet when the inflatable object is in the upright position.

6. The device of claim 1 wherein the removable surface is configured to be removed in two or more portions.

7. The device of claim 1 wherein the inflatable object is a character.

8. The device of claim 1 wherein the inflatable object is a geometric shape.

9. The device of claim 1 further comprising two or more wheels disposed within and protruding from the base portion, the wheels configured to permit the device to roll.

10. The device of claim 9 wherein the wheels are spring-loaded, the spring-loaded wheels configured to propel the device.

11. A toy device comprising:

a base portion, the base portion having an inlet and an outlet, the outlet covered by a removable surface;

an injectable object disposed within the base portion when not filled, the injectable object being fluidly connected to the inlet;

a syringe fluidly connected to the inlet, the syringe having a plunger configured to create fluid pressure to fill the injectable object;

wherein the injectable object protrudes from the base portion outlet, thereby removing the removable surface, upon being filled.

12. The device of claim 11 further comprising a hose fluidly interconnecting the syringe to the base portion inlet.

13. The device of claim 11 wherein depressing the syringe plunger fills the injectable object to move the injectable object to an upright position substantially disposed outside of the base portion.

14. The device of claim 13 wherein the base portion inlet is configured to be closed to maintain the filled injectable object in the upright position.

15. The device of claim 14 wherein the syringe is configured to be removed from the base portion inlet when the injectable object is in the upright position.

16. The device of claim 11 wherein the removable surface is configured to be removed in two or more portions.

17. The device of claim 11 wherein the injectable object is a character.

18. The device of claim 11 wherein the injectable object is a geometric shape.

19. The device of claim 11 further comprising two or more wheels disposed within and protruding from the base portion, the wheels configured to permit the device to roll.

20. The device of claim 19 wherein the wheels are spring-loaded, the spring-loaded wheels configured to propel the device.

* * * * *